US010435831B1

(12) United States Patent
Harry-Ogiste

(10) Patent No.: US 10,435,831 B1
(45) Date of Patent: Oct. 8, 2019

(54) FABRIC TREATING ACCESSORIES AND ASSOCIATED USE THEREOF

(71) Applicant: Rita Harry-Ogiste, Brooklyn, NY (US)

(72) Inventor: Rita Harry-Ogiste, Brooklyn, NY (US)

( * ) Notice: Subject to any disclaimer, the term of this patent is extended or adjusted under 35 U.S.C. 154(b) by 0 days.

(21) Appl. No.: 16/034,248

(22) Filed: Jul. 12, 2018

Related U.S. Application Data

(63) Continuation-in-part of application No. 14/800,450, filed on Jul. 15, 2015, now abandoned.

(60) Provisional application No. 62/024,685, filed on Jul. 15, 2014.

(51) Int. Cl.

| | |
|---|---|
| ***D06B 1/02*** | (2006.01) |
| ***D06B 11/00*** | (2006.01) |
| ***B05B 1/02*** | (2006.01) |
| ***C11D 11/00*** | (2006.01) |
| ***B05B 7/00*** | (2006.01) |
| ***B05B 15/30*** | (2018.01) |
| ***C11D 3/00*** | (2006.01) |
| ***B05B 7/02*** | (2006.01) |

(52) U.S. Cl.
CPC ..... *D06B 1/02* (2013.01); *B05B 1/02* (2013.01); *B05B 7/00* (2013.01); *B05B 7/02* (2013.01); *B05B 15/30* (2018.02); *C11D 3/0015* (2013.01); *C11D 11/0017* (2013.01); *D06B 11/0059* (2013.01)

(58) Field of Classification Search
CPC ..... D06B 1/02; D06B 11/0059; B05B 7/02; B05B 15/30; B05B 1/02; B05B 7/00; C11D 3/0015; C11D 11/0017
USPC ..... 222/136, 137, 138, 214
See application file for complete search history.

(56) References Cited

U.S. PATENT DOCUMENTS

| | | | | | |
|---|---|---|---|---|---|
| 4,045,361 | A * | 8/1977 | Watt, Jr. | C11D 1/40 | 510/522 |
| 4,134,838 | A * | 1/1979 | Hooper | A61K 8/416 | 510/518 |
| 4,661,268 | A * | 4/1987 | Jacobson | D06M 15/647 | 252/8.91 |
| 4,792,409 | A * | 12/1988 | Sherman | C11D 1/62 | 510/527 |
| 5,100,566 | A * | 3/1992 | Agbomeirele | D06M 13/144 | 252/8.91 |
| 5,573,695 | A * | 11/1996 | Targosz | D06M 13/46 | 252/8.91 |
| 5,634,571 | A * | 6/1997 | Cataneo | B05B 7/32 | 222/134 |
| 5,670,476 | A * | 9/1997 | Vogel | C11D 1/58 | 510/500 |

(Continued)

*Primary Examiner* — Arthur O. Hall
*Assistant Examiner* — Steven M Cernoch
(74) *Attorney, Agent, or Firm* — Ashkan Najafi

(57) ABSTRACT

An apparatus includes a dispensing bottle including a reservoir and a spray nozzle in fluid communication therewith, and a homogenous solution housed within the reservoir. Such a homogenous solution includes between 40% and 45%, by weight, of a wrinkle remover; between 40% and 45%, by weight, of a fabric softener; and between 10% and 20%, by weight, of a viscosity reducer. Advantageously, the solution is an aqueous mixture having a viscosity level between 1.0 and 2.0 centipoise at 25 degrees Celsius wherein, upon actuating the spray nozzle, the solution is caused to expel outwardly and away from the reservoir due to its low viscosity characteristics.

11 Claims, 9 Drawing Sheets

(56) References Cited

U.S. PATENT DOCUMENTS 5,740,947 A * 4/1998 Flaig ..... B05B 11/3084 220/23.4
5,848,730 A * 12/1998 Kawase ..... A45D 19/02 222/94
6,374,688 B1 * 4/2002 Bockmann ..... F16H 61/16 74/336 R
6,871,760 B1 * 3/2005 Snider ..... B05B 11/0037 222/129
7,371,718 B2 * 5/2008 Wood ..... C11D 1/62 510/488
7,557,077 B2 * 7/2009 Harrison ..... C11D 1/525 510/276
7,798,366 B2 * 9/2010 Hoshino ..... B65D 83/62 222/105
7,819,342 B2 * 10/2010 Spallek ..... A61M 15/0065 222/137
7,875,001 B2 * 1/2011 Minotti ..... A61M 15/08 222/137
8,225,962 B2 * 7/2012 Rossignol ..... B05B 11/0078 222/137
8,353,431 B2 * 1/2013 Ward, II ..... B05B 11/30 222/464.7
8,474,659 B2 * 7/2013 Dennis ..... B05B 15/30 222/137
9,776,787 B2 * 10/2017 Nakajima ..... B65D 83/682
9,839,930 B2 * 12/2017 Burrowes ..... B05B 15/20
2005/0039266 A1 * 2/2005 Kvita ..... C11D 3/0021 8/115.51
2006/0107466 A1 * 5/2006 Sassi ..... C08G 83/005 8/115.51
2006/0207033 A1 * 9/2006 Chrobaczek ..... C08G 77/26 8/115.51
2007/0068966 A1 * 3/2007 Orzech ..... B67D 1/108 222/136
2010/0108779 A1 * 5/2010 Filsouf ..... B05B 11/0054 239/61
2011/0215113 A1 * 9/2011 Hansen ..... B65D 83/202 222/136
2012/0279990 A1 * 11/2012 Werner ..... B05B 11/3083 222/132
2013/0299515 A1 * 11/2013 Geiberger ..... B05B 11/0078 222/136
2014/0326753 A1 * 11/2014 Turner ..... A61L 2/18 222/138
2016/0038959 A1 * 2/2016 Lopez et al. ..... B05B 11/3011 222/135

* cited by examiner

FABRIC TREATING ACCESSORIES AND ASSOCIATED USE THEREOF

CROSS REFERENCE TO RELATED APPLICATIONS

This is a Continuation-In-Part Application of U.S. patent application Ser. No. 14/800,450, filed Jul. 15, 2015, which claims the benefit of U.S. Provisional Application No. 62/024,685 filed Jul. 15, 2014, the entire disclosures of which are incorporated by reference herein.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

Technical Field

Exemplary embodiment(s) of the present disclosure relate to garment treating accessories and, more particularly, to a spray-dispersible liquid chemical composition that provides a combined wrinkle-remover and fabric-softener for garments (textiles).

Prior Art

Rinse-cycle fabric conditioning is widely used. Such rinse-cycle fabric conditioning imparts to laundered fabrics a texture or handle that is smooth, pliable and fluffy to the touch. Moreover, conditioning of fabrics in the deep rinse can also impart to laundered fabrics a reduced tendency to pick up and/or retain static charge. The former property of conditioned fabrics is generally called fabric "softness" and the latter property is generally called fabric "static control". Unfortunately, such rinse-cycle fabric conditioning must be used during a rinse cycle of a washing machine or the like.

In addition, widely used rinse-added fabric conditioning compositions are aqueous suspensions or emulsions comprising major amounts of water, lesser amounts of fabric conditioning compounds, and minor amounts of optional ingredients such as perfumes, dyes, preservatives and stabilizers. These aqueous compositions can be conveniently added to the rinse bath during the rinsing cycle of automatic laundry operations.

Fabric, especially cellulose based fabric, inter alia, cotton, has a propensity to wrinkle either upon drying after the laundry process or when worn. Permanent press finishes have been used to provide a crisp, smooth garment, however, permanent press processes must modify the fabric itself, either by cross linking of the cellulose fiber or by applying a less flexible coating material. The breathability, especially of cotton, is sacrificed if the applied coating or crosslinking fills the interstices of the fiber cells.

For natural fiber, inter alia, cotton, most coatings must be chemically reacted with the fabric fiber itself in order to obtain the desired level of anti-wrinkle properties. This type of treatment also can occur during the synthesis of polyester fabrics as well. To achieve controlled deposition, there must be an affinity for a fabric surface and the ability of a substrate to lie down onto the garment surface is key to achieving and maintaining a smooth fabric surface.

There is, therefore, a long felt need in the art for a fabric treatment system which provides anti-wrinkle benefits to fabric regardless of fabric type, and which does not require chemical bonding of the substrate to the fabric itself.

The present disclosure helps remove wrinkles from fabrics, including clothing, dry cleanable fabrics and draperies, without the need for ironing. The present disclosure can be used on washed clothing, which is damp or dry, to relax wrinkles and give clothes a ready to wear look that is demanded by today's consumer. The present disclosure also essentially eliminates the need for touch up ironing usually associated with closet, drawer, and suitcase storage of garments.

Because wrinkles are generally undesirable, a liquid fabric softener that also decreases or eliminates wrinkles would be a welcomed additional benefit. In particular, it is desirable to provide a combined fabric softener and wrinkle remover that can be sprayed onto the textile without the need for a washing machine (e.g., rinse cycle).

Accordingly, a need remains for a fabric-treating chemical composition in order to overcome at least one prior art shortcoming. The exemplary embodiment(s) satisfy such a need by providing a liquid chemical composition for a combined wrinkle-remover and fabric-softener that is convenient and easy to use, lightweight yet durable in design, versatile in its applications, and designed to remove wrinkles and soften garments.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an apparatus for removing wrinkles from fabrics and softening the fabrics. These and other objects, features, and advantages of the non-limiting exemplary embodiment(s) are provided by an apparatus containing a chemical composition for conditioning fabrics during home laundering operations. More specifically, this disclosure relates to chemical compositions that are employed not during a laundry rinse cycle in order to improve the tactile properties of laundered fabrics. The chemical compositions produce minimal fabric staining and can be prepared in highly stable form.

In a non-limiting exemplary embodiment(s), the apparatus includes a dispensing bottle including a reservoir and a spray nozzle in fluid communication therewith, and a homogenous solution housed within the reservoir. Such a homogenous solution includes between 40% and 45%, by weight, of a wrinkle remover; between 40% and 45%, by weight, of a fabric softener; and between 10% and 20%, by weight, of a viscosity reducer. Advantageously, the solution is an aqueous mixture having a viscosity level between 1.0 and 2.0 centipoise at 25 degrees Celsius wherein, upon actuating the spray nozzle, the solution is caused to expel outwardly and away from the reservoir due to its low viscosity characteristics.

In a non-limiting exemplary embodiment, the viscosity reducer includes a polyorganosiloxane.

In a non-limiting exemplary embodiment, the wrinkle remover is 40% by weight; the fabric softener is 40% by weight; the viscosity reducer is 20% by weight; and the viscosity level is 1.0 centipoise at 25 degrees Celsius.

In a non-limiting exemplary embodiment, the wrinkle remover is 45% by weight; the fabric softener is 45% by weight; the viscosity reducer is 10% by weight; and the viscosity level is 2.0 centipoise at 25 degrees Celsius.

The disclosure further includes a method of utilizing an apparatus for removing wrinkles from fabrics and softening the fabrics. Such a method includes the steps of: providing a dispensing bottle including a reservoir and a spray nozzle in fluid communication therewith; providing a solution including between 40% and 45%, by weight, of a wrinkle remover; between 40% and 45%, by weight, of a fabric softener; and between 10% and 20%, by weight, of a viscosity reducer wherein the solution is a homogenous aqueous mixture having a viscosity level between 1.0 and 2.0 centipoise at 25 degrees Celsius.

The method further includes the steps of: pouring the solution into the reservoir; providing a fabric; and actuating the dispensing bottle, thereby spraying the solution outwardly and away from the reservoir, due to its low viscosity characteristics, and on the fabric such that a texture of the fabric is softened and wrinkles on the fabric are removed.

The present disclosure further includes an apparatus for removing wrinkles from fabrics and softening the fabrics. Such an apparatus includes a portable, hand-held dispensing bottle including a reservoir having a first chamber adapted to contain a first liquid therein and a second chamber adapted to contain a second liquid therein. The second chamber is disposed adjacent to the first chamber, and a spray nozzle is in fluid communication with each of the first chamber and the second chamber. A mechanism for regulating a flow rate of each the first liquid and the second liquid flowing out from the first chamber and the second chamber, is provided. Such a flow rate regulating mechanism is coupled to the reservoir and the spray nozzle in such a manner that a first quantity of the first liquid and a second quantity of the second liquid are selectively extracted from the first chamber and the second chamber, respectively, and thereby form a solution prior to being discharged from the spray nozzle. Advantageously, upon actuation of the spray nozzle, the solution is caused to expel outwardly and away from the reservoir due to its low viscosity characteristics.

The solution includes between 40% and 45%, by weight, of a wrinkle remover, between 40% and 45%, by weight, of a fabric softener, and between 10% and 20%, by weight, of a viscosity reducer. In this manner, the solution is an aqueous mixture having a viscosity level between 1.0 and 2.0 centipoise at 25 degrees Celsius. The first liquid contains the wrinkle remover, and the second liquid contains the fabric softener and the viscosity reducer.

In a non-limiting exemplary embodiment, the reservoir includes a first tube disposed within the first chamber and coupled to the spray nozzle, and a second tube disposed within the second chamber and coupled to the spray nozzle.

In a non-limiting exemplary embodiment, the flow rate regulating mechanism includes: a rotary valve centrally seated subjacent to the spray nozzle and above each of the first chamber and the second chamber. Advantageously, the rotary valve is selectively rotated, about a centrally registered longitudinal axis of the reservoir, in a clockwise direction and a counter clockwise direction.

In a non-limiting exemplary embodiment, the rotary valve includes a C-shaped section positioned above the first chamber and the second chamber. Such a C-shaped section is in selective contact with each of the first tube and the second tube. A linear lever is attached to the C-shaped section and extended out from the reservoir. Advantageously, displacement of the linear lever about the centrally registered longitudinal axis causes diametrically opposed ends of the C-shaped section to selectively engage the first tube and the second tube.

In a non-limiting exemplary embodiment, each of the opposed ends of the C-shaped section includes a curvilinear slot having a width converging (gradually decreases in width) towards the linear lever.

In a non-limiting exemplary embodiment, each of the first tube and the second tube is selectively squeezed when slidably inserted into a corresponding one of the angled slot, and thereby restricts a flow rate of first liquid and the second liquid egressed from the first chamber and the second chamber, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
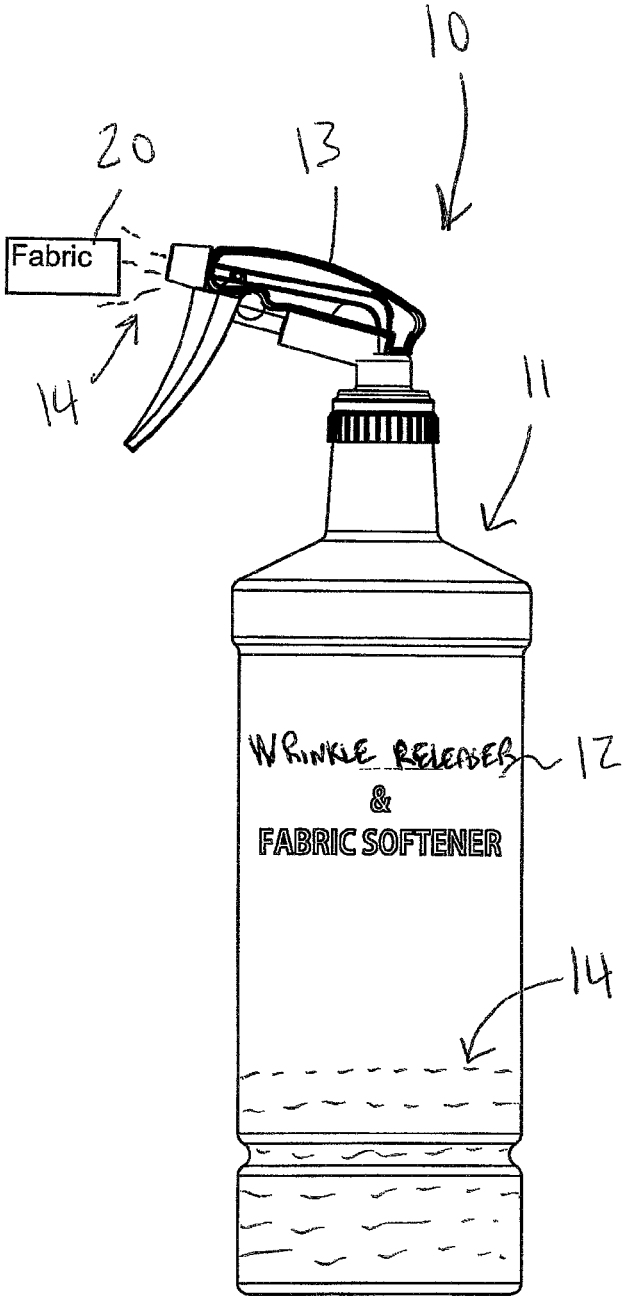
FIG. 1 is a front elevational view of a dispensing bottle that sprays a chemical composition for a combined wrinkle remover (releaser) and fabric softener, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

The non-limiting exemplary embodiment(s) is/are referred to generally in FIGS. 1-15 and is/are intended to provide an apparatus 10 containing a chemical composition 14 for a combined wrinkle-remover and fabric-softener to remove wrinkles and soften fabric. The term "chemical composition," "composition," "solution," and "mixture" are interchangeably used throughout the present disclosure.

A non-limiting exemplary embodiment(s) of the present disclosure is referred to generally in the figures and is intended to provide an apparatus 10 and a liquid chemical composition 14 for a combined wrinkle-remover and fabric-softener to remove wrinkles and soften garments. It should be understood that the exemplary embodiment(s) may be used to treat a variety of fabrics, and should not be limited to any particular fabric described herein.

Figure 2:
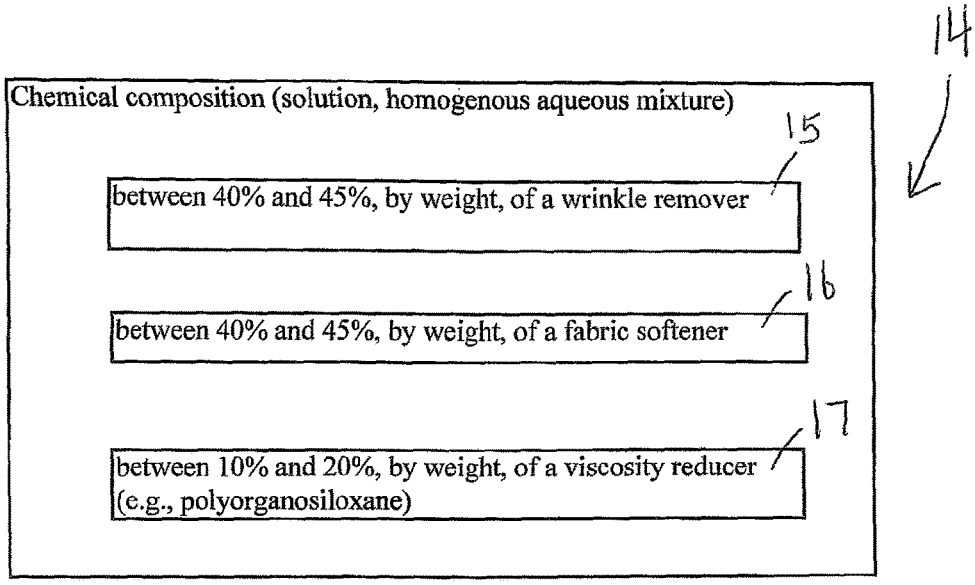
FIG. 2 is a block diagram illustrating the combination of ingredients of the chemical composition.
Figure 3:
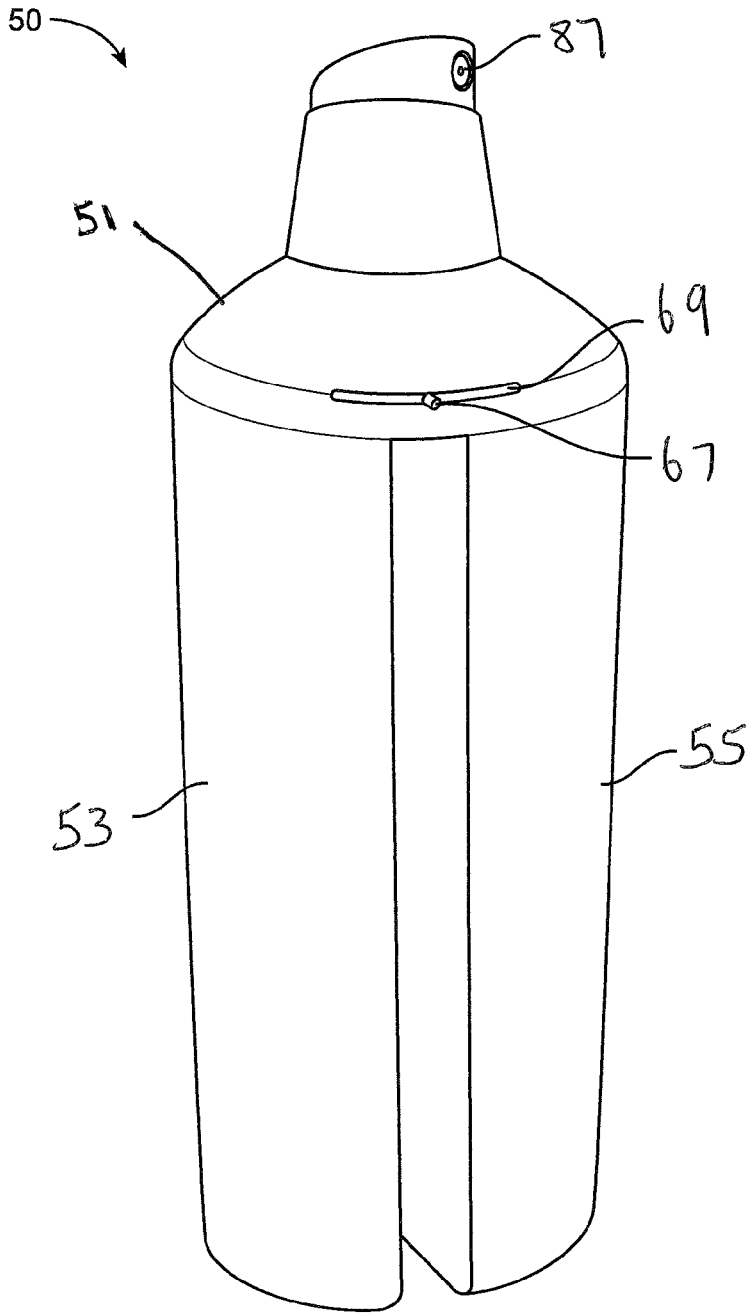
FIG. 3 is perspective view of a dispensing bottle that sprays a chemical composition for a combined wrinkle remover (releaser) and fabric softener, in accordance with a non-limiting exemplary embodiment.
Figure 4:
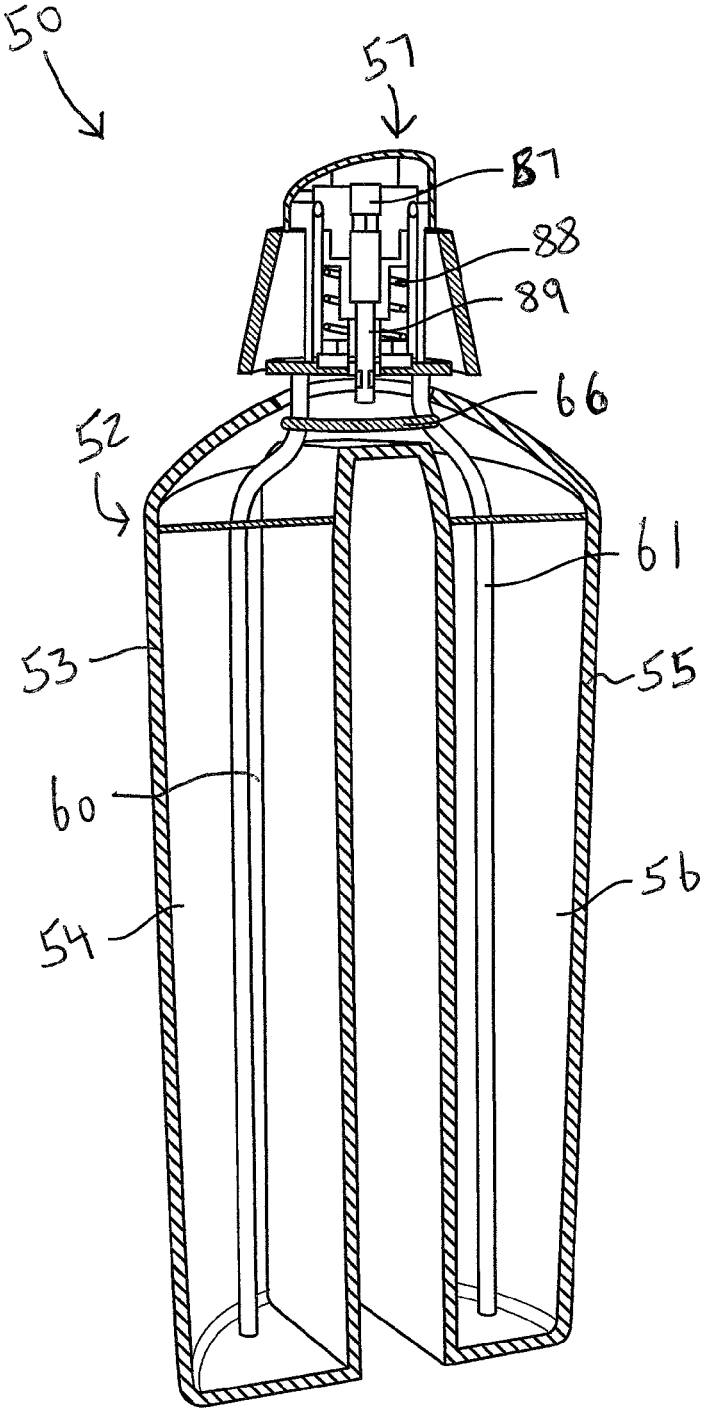
FIG. 4 is a cross-sectional view of the dispensing bottle shown in FIG. 3.
Figure 5:
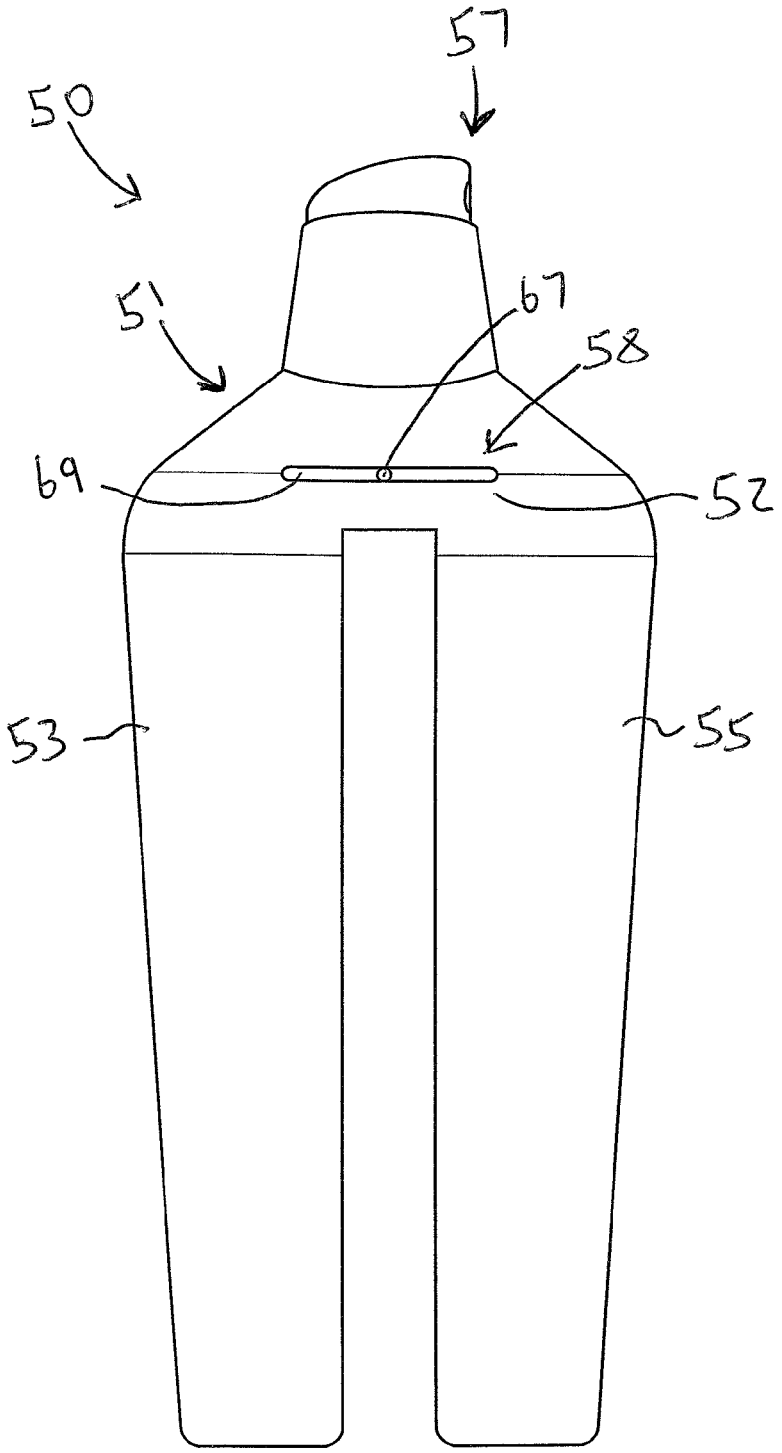
FIG. 5 is a side elevational view of the dispensing bottle shown in FIG. 3.
Figure 6:
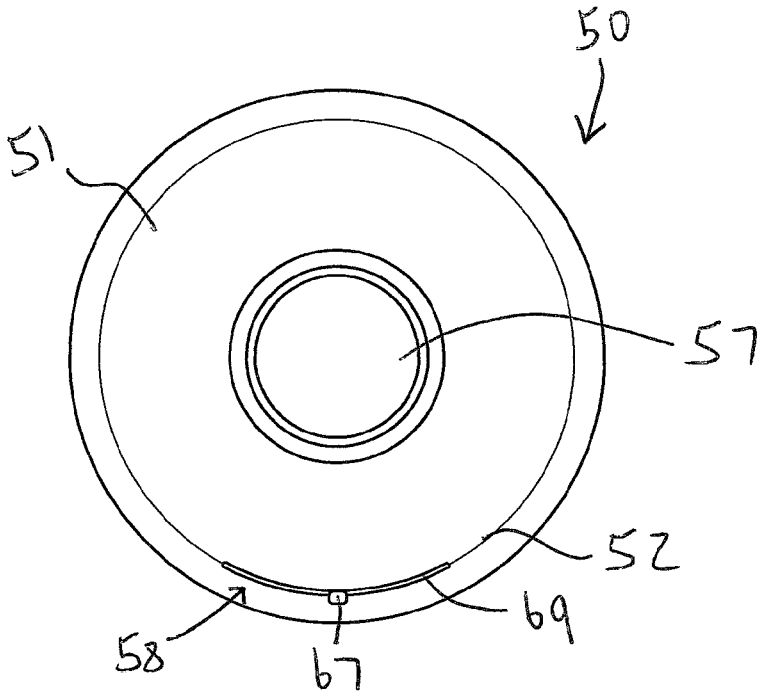
FIG. 6 is a top plan view of the dispensing bottle shown in FIG. 3.
Figure 7:
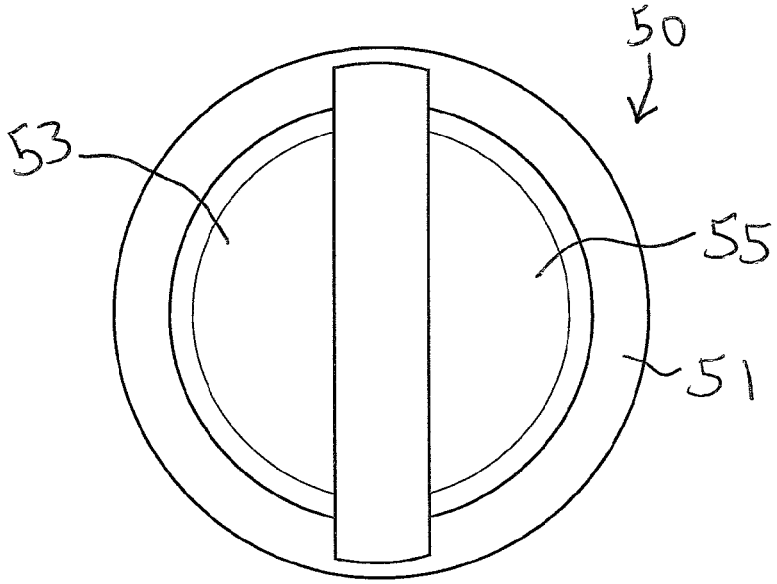
FIG. 7 is a bottom plan view of the dispensing bottle shown in FIG. 3.
Figure 8:
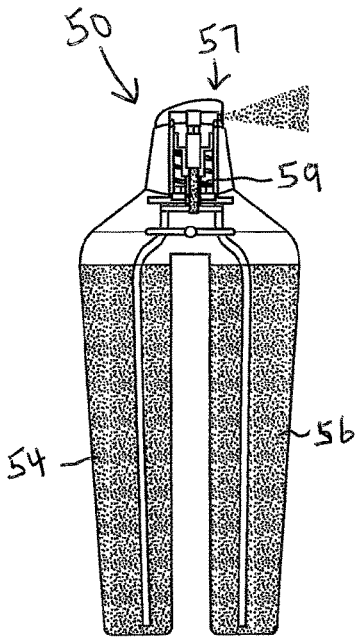
FIG. 8 is a partial transparent view of the dispensing bottle shown in FIG. 3, wherein the flow rate regulating mechanism is at a central position.
Figure 9:
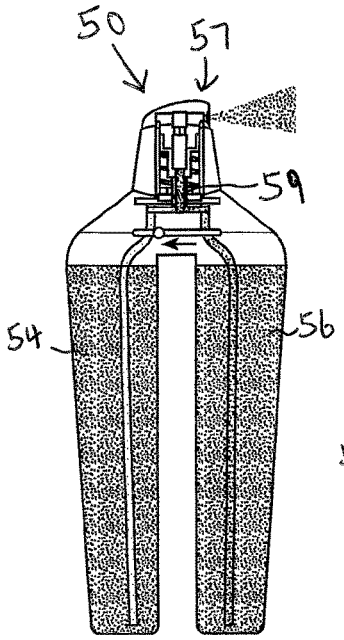
FIG. 9 is a partial transparent view of the dispensing bottle shown in FIG. 3, wherein the flow rate regulating mechanism is at a left position for restricting fluid from egressing from the first chamber.
Figure 10:
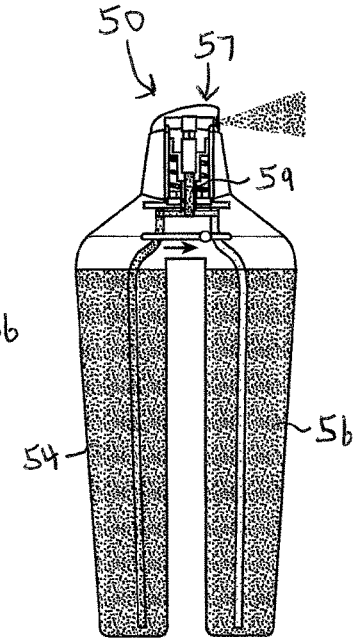
FIG. 10 is a partial transparent view of the dispensing bottle shown in FIG. 3, wherein the flow rate regulating mechanism is at a right position for restricting fluid from egressing from the second chamber.
Figure 11:
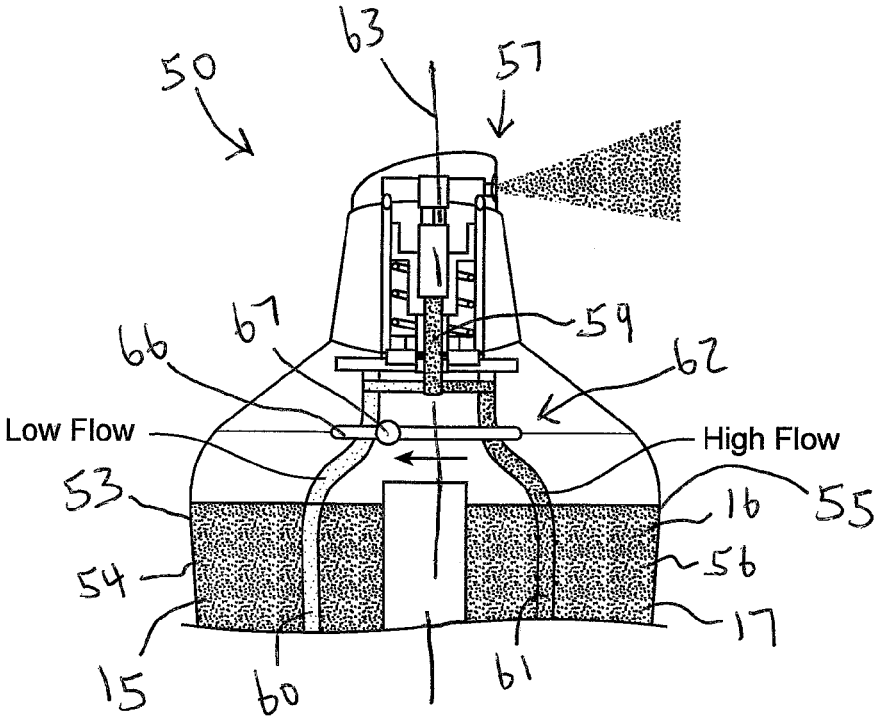
FIG. 11 is an enlarged partial view of the flow rate regulating mechanism shown in FIG. 9.
Figure 12:
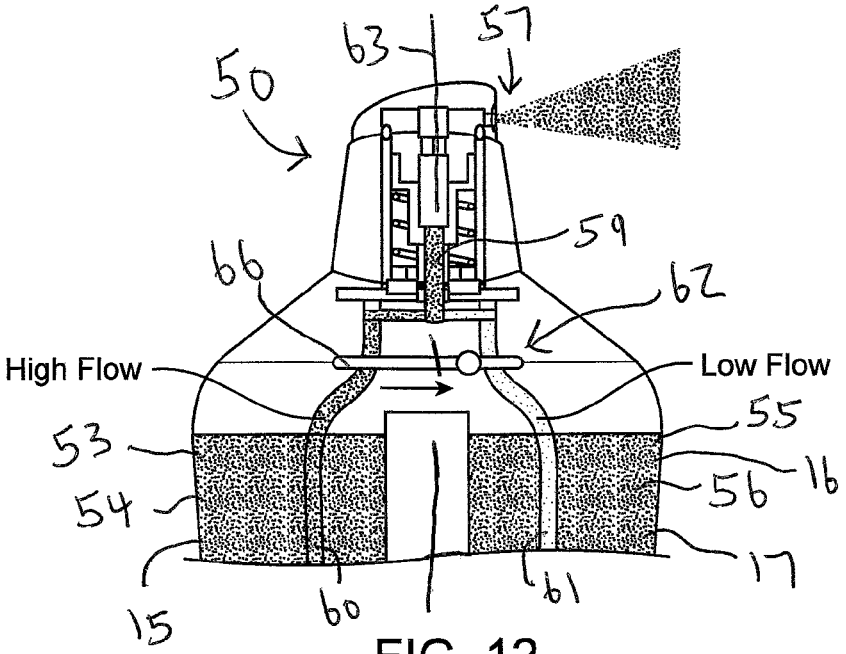
FIG. 12 is an enlarged partial view of the flow rate regulating mechanism shown in FIG. 10.
Figure 13:
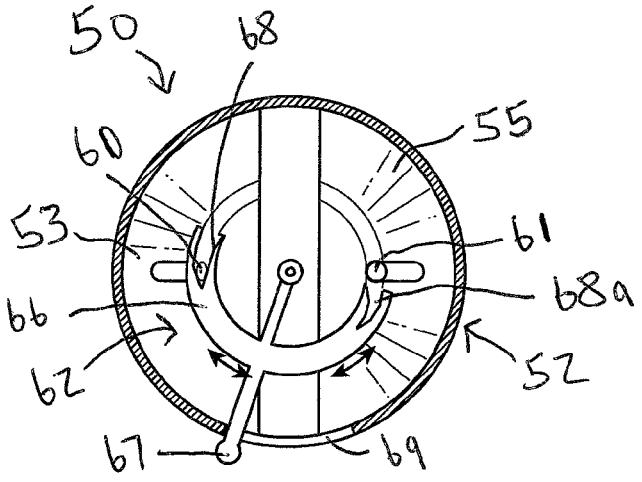
FIG. 13 is top plan view of the flow rate regulating mechanism shown in FIG. 9.
Figure 14:
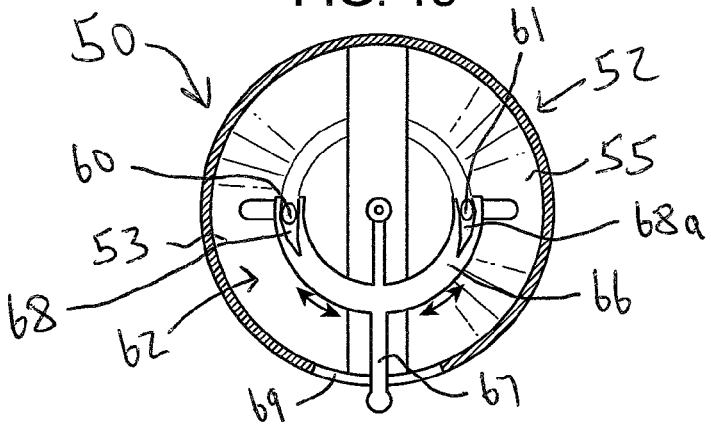
FIG. 14 is top plan view of the flow rate regulating mechanism shown in FIG. 8.
Figure 15:
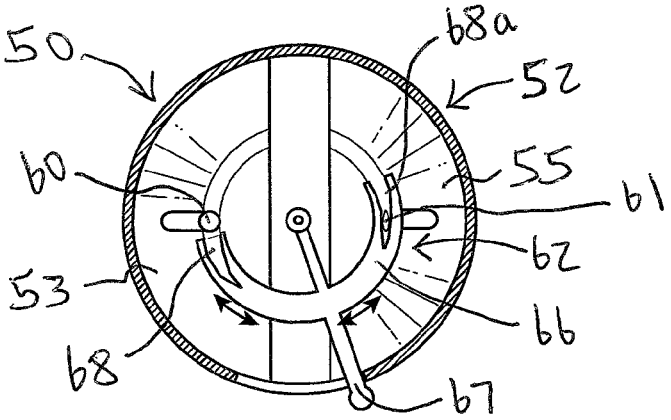
FIG. 15 is top plan view of the flow rate regulating mechanism shown in FIG. 10.

Referring to FIGS. 1-2 general, an apparatus 10 for removing wrinkles from fabrics and softening the fabrics. The apparatus 10 contains a chemical composition 14 for conditioning fabrics during home laundering operations. More specifically, this disclosure relates to a dispenser and chemical compositions 14 that are employed not during a laundry rinse cycle in order to improve the tactile properties of laundered fabrics. The chemical compositions 14 produce minimal fabric staining and can be prepared in highly stable form.

In a non-limiting exemplary embodiment, the apparatus 10 includes a dispensing bottle 11 including a reservoir 12 and a spray nozzle 13 in fluid communication therewith, and a homogenous solution 14 housed within the reservoir 12. Such a homogenous solution 14 includes between 40% and 45%, by weight, of a wrinkle remover 15; between 40% and 45%, by weight, of a fabric softener 16; and between 10% and 20%, by weight, of a viscosity reducer 17. Advantageously, the solution 14 is an aqueous mixture having a viscosity level between 1.0 and 2.0 centipoise at 25 degrees Celsius wherein, upon actuating the spray nozzle 13, the solution 14 is caused to expel outwardly and away from the reservoir 12 due to its low viscosity characteristics.

In a non-limiting exemplary embodiment, the viscosity reducer 17 includes a polyorganosiloxane.

In a non-limiting exemplary embodiment, the wrinkle remover 15 is 40% by weight; the fabric softener 16 is 40% by weight; the viscosity reducer 17 is 20% by weight; and the viscosity level is 1.0 centipoise at 25 degrees Celsius.

In a non-limiting exemplary embodiment, the wrinkle remover 15 is 45% by weight; the fabric softener 16 is 45% by weight; the viscosity reducer 17 is 10% by weight; and the viscosity level is 2.0 centipoise at 25 degrees Celsius.

The disclosure further includes a method of utilizing an apparatus 10 for removing wrinkles from fabrics and softening the fabrics. Such a method includes the steps of: providing a dispensing bottle 11 including a reservoir 12 and a spray nozzle 13 in fluid communication therewith; providing a solution 14 including between 40% and 45%, by weight, of a wrinkle remover 15; between 40% and 45%, by weight, of a fabric softener 16; and between 10% and 20%, by weight, of a viscosity reducer 17 wherein the solution 14 is a homogenous aqueous mixture 14 having a viscosity level between 1.0 and 2.0 centipoise at 25 degrees Celsius.

The method further includes the steps of: pouring the solution 14 into the reservoir 12; providing a fabric; and actuating the dispensing bottle 11, thereby spraying the solution 14 outwardly and away from the reservoir 12, due to its low viscosity characteristics, and on the fabric 20 such that a texture of the fabric 20 is softened and wrinkles on the fabric 20 are removed.

In a non-limiting exemplary embodiment, wrinkle and fabric softer composition 14 combines a liquid fabric softener 16 with a liquid wrinkle-remover 15 in a pump-spray bottle 11, this product to be offered in a variety of sizes—from a three-ounce travel bottle designed to meet transportation security administration restrictions, to a 16- or 20-ounce family-size bottle for household use—and designed to quickly and easily soften and freshen the fabric, and remove the wrinkles, from virtually any garment or fabric. As an example, the composition 14 may include, inter alia: De-ionized Water; Ethanol; Sodium Carboxymethyl Cellulose; Polyethylene Glycol; Butane; Propane; Sodium Nitrite; Morpholine; Polysorbate 20; and Fragrance.

In a non-limiting exemplary embodiment, the chemical composition 14 may include sodium carboxymethyl as a soil suspension polymer designed to deposit onto cotton and other cellulosic fabrics, creating a negatively charged barrier to soils in the wash solution.

Regarding the wrinkle releaser, such compounds are disclosed in U.S. Pat. No. 3,674,688 to Schwartz et al.; U.S. Pat. No. 5,573,695 to Targoz; U.S. Pat. No. 4,661,268 to Jacobson et al.; and U.S. Pat. No. 5,100,566 to Agbomeirele et al., all of which are incorporated by reference herein.

Regarding the fabric softener 16, such compounds are disclosed in U.S. Pat. No. 4,792,409 to Sherman et al.; U.S. Pat. No. 5,670,476 to Vogel et al.; U.S. Pat. No. 7,371,718 to Wood et al.; and U.S. Pat. No. 4,045,361 to Watt et al., all of which are incorporated by reference herein. Additional fabric softeners are more definitively described in U.S. Pat. No. 4,134,838, the disclosure of which is incorporated by reference herein. Preferred fabric softeners for use herein are acyclic quaternary ammonium salts. Mixtures of the above mentioned fabric softeners may also be used.

In a non-limiting exemplary embodiment, the combined fabric softener and wrinkle reducer composition 14 can, for example, be prepared by mixing a preformulated fabric softener and wrinkle reducer with an emulsion comprising the polyorganosiloxane and the additive. For this reason, the flow improver 17 (viscosity reducing agent) is added as additives to the composition 14. For example, it is possible to add fatty acid derivatives, waxes or silicone compounds as flow improvers.

In a non-limiting exemplary embodiment, the flowability of the composition 14 can be improved by treating composition 14 with flow improvers 17 such as clay, silica or zeolite particles, water-soluble inorganic salts, starch, etc. Such ingredients may be stirred and diluted in water, then added to solution 14.

In a non-limiting exemplary embodiment, the composition 14 may also comprise additives, for example alcohols, such as ethanol, n-propanol, propanol, polyhydric alcohols, for example glycerol and propylene glycol; amphoteric and nonionic surfactants, for example carboxyl derivatives of imidazole, oxyethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, dyes, hydrotropic agents, antifoams, anti redeposition agents, polymeric or other thickeners, enzymes, optical brighteners, antishrink agents, stain removers, germicides, fungicides, antioxidants and corrosion inhibitors.

In a non-limiting exemplary embodiment, the solution 14 is prepared as dispersions containing the active material in water along with solvents can be prepared as microemulsions which have a clear appearance (as to the solvents and the formulations see for example U.S. Pat. No. 5,543,067). The additives and polyorganosiloxanes of the present disclosure can be used for such compositions although it will be necessary to use them in microemulsion form to preserve the clear appearance of the homogenous aqueous mixture 14 which are microemulsions.

In a non-limiting exemplary embodiment, the fabric softener 16, wrinkle remover 15 and flow improver 17 are mixed together wherein heating and mixing continues until the batch is homogeneous. At this point, cool water is circulated around a tank to lower the temperature. As the batch cools, the remaining ingredients, such as preservatives, dyes, and fragrance, are added. These ingredients are used at much lower concentrations, typically below no more than a few percent for fragrance and less than 1% for preservatives and dyes. The completed batch may be pumped to a filling line or stored in tanks until it is ready to be filled.

When the solution 14 is ready to be filled into the package, it is transferred to an automated filling line. Plastic bottles are fed onto a conveyor belt that carries them under a filling nozzle. At the filling head there is a large hopper that holds the formulation and discharges a controlled amount, usually set by volume, into the bottle. The filled package continues down the conveyor line to a capping machine that applies the closure and tightens it. Finally, the filled bottles are packed in cartons and stacked pallets for shipping.

The wrinkle remover and fabric softer mixture 14 with flow improver 17 has many uses. At home, a quick spray of the garments coming out of the dryer would soften and refresh the fabric, and remove the wrinkles—no need to set up the ironing board or fill and plug that steam iron. In the office, a quick spray of a suit, dress, or skirt before a meeting would freshen and revitalize one's professional wardrobe—and take away any stubborn wrinkles. Likewise, the business or pleasure traveler in a hotel room could travel light, yet retain a fresh and well-pressed look with no trouble—and very little expense.

So useful the wrinkle remover 15 and fabric softer mixture 14 with flow improver 17, indeed, would be that most consumers would likely choose to keep a family-size bottle in the home laundry room; a travel-size bottle with their luggage and toiletries; and another travel-size bottle in the workplace or office or car—for one never knows when a "fashion emergency" might come up. In short, then, the wrinkle remover and fabric softener mixture 14 presents itself as clever in conception and incredibly useful; and clearly, should this product be successfully developed to the point of mass-production, marketing, and distribution.

Referring to FIGS. 2-15, the present disclosure further includes an apparatus 50 for removing wrinkles from fabrics and softening the fabrics. Such an apparatus 50 includes a portable, hand-held dispensing bottle 51 including a reservoir 52 having a first chamber 53 adapted to contain a first liquid 54 therein and a second chamber 55 adapted to contain a second liquid 56 therein. The second chamber 55 is disposed adjacent to the first chamber 53, and a spray nozzle 57 is in fluid communication with each of the first chamber 53 and the second chamber 55. A mechanism 58 for regulating a flow rate of each the first liquid 54 and the second liquid 56 flowing out from the first chamber 53 and the second chamber 55, is provided. Such a flow rate regulating mechanism 58 is coupled to the reservoir 52 and the spray nozzle 57 in such a manner that a first quantity of the first liquid 54 and a second quantity of the second liquid 56 are selectively extracted from the first chamber 53 and the second chamber 55, respectively, and thereby form a solution 59 prior to being discharged from the spray nozzle 57. Advantageously, upon actuation of the spray nozzle 57, the solution 59 is caused to expel outwardly and away from the reservoir 52 due to its low viscosity characteristics.

The spray nozzle 57 preferably includes a discharge head 87 coupled to a pneumatic siphon 89 and spring 88 at the top of the bottle 50. Such components operate in a conventional manner to suck fluid out from the reservoirs 53, 55.

The solution 59 includes between 40% and 45%, by weight, of a wrinkle remover 15, between 40% and 45%, by weight, of a fabric softener 16, and between 10% and 20%, by weight, of a viscosity reducer 17. In this manner, the solution 59 is an aqueous mixture having a viscosity level between 1.0 and 2.0 centipoise at 25 degrees Celsius. The first liquid 54 contains the wrinkle remover 15, and the second liquid 56 contains the fabric softener 16 and the viscosity reducer 17.

In a non-limiting exemplary embodiment, the reservoir 52 includes a first tube 60 disposed within the first chamber 53 and coupled to the spray nozzle 57, and a second tube 61 disposed within the second chamber 55 and coupled to the spray nozzle 57.

In a non-limiting exemplary embodiment, the flow rate regulating mechanism 58 includes: a rotary valve 62 centrally seated subjacent to the spray nozzle 57 and above each of the first chamber 53 and the second chamber 55. Advantageously, the rotary valve 62 is selectively rotated, about a centrally registered longitudinal axis 63 of the reservoir 52, in a clockwise direction 64, 65 and a counter clockwise direction 64, 65.

In a non-limiting exemplary embodiment, the rotary valve 62 includes a C-shaped section 66 positioned above the first chamber 53 and the second chamber 55. Such a C-shaped section 66 is in selective contact with each of the first tube 60 and the second tube 61. A linear lever 67 is attached to the C-shaped section 66 and extended out from the reservoir 52. Advantageously, displacement of the linear lever 67 about the centrally registered longitudinal axis 63 causes diametrically opposed ends of the C-shaped section 66 to selectively engage the first tube 60 and the second tube 61. The linear lever 67 is guided along an arcuate opening 69 in the reservoir 52.

In a non-limiting exemplary embodiment, each of the opposed ends of the C-shaped section 66 includes a curvilinear slot 68, **68*a* having a width converging (gradually decreases in width) towards the linear lever 67**.

In a non-limiting exemplary embodiment, each of the first tube 60 and the second tube 61 is selectively squeezed when slidably inserted into a corresponding one of the angled slot 68, **68*a*, and thereby restricts a flow rate of first liquid 54 and the second liquid 56 egressed from the first chamber 53 and the second chamber 55**, respectively.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An apparatus for removing wrinkles from fabrics and softening the fabrics, comprising:

a dispensing bottle including a reservoir having a first chamber adapted to contain a first liquid therein and a second chamber adapted to contain a second liquid therein, said second chamber being disposed adjacent to said first chamber, a spray nozzle in fluid communication with each of said first chamber and said second chamber; and mechanism for regulating a flow rate of each said first liquid and said second liquid flowing out from said first chamber and said second chamber, said flow rate regulating mechanism being coupled to said reservoir and said spray nozzle in such a manner that a first quantity of said first liquid and a second quantity of said second liquid are selectively extracted from said first chamber and said second chamber, respectively, and thereby form a solution prior to being discharged from said spray nozzle;

wherein said solution includes between 40% and 45%, by weight, of a wrinkle remover, between 40% and 45%, by weight, of a fabric softener, and between 10% and 20%, by weight, of a viscosity reducer;

wherein said solution is an aqueous mixture having a viscosity level between 1.0 and 2.0 centipoise at 25 degrees Celsius;

wherein, upon actuation of said spray nozzle, said solution is caused to expel outwardly and away from said reservoir due to its low viscosity characteristics;

wherein said first liquid contains said wrinkle remover;

wherein said second liquid contains said fabric softener and said viscosity reducer;

wherein said reservoir comprises a first tube disposed within said first chamber and coupled to said spray nozzle, and a second tube disposed within said second chamber and coupled to said spray nozzle;

wherein said flow rate regulating mechanism comprises a rotary valve centrally seated subjacent to said spray nozzle and above each of said first chamber and said second chamber;

wherein said rotary valve is selectively rotated, about a centrally registered longitudinal axis of said reservoir, in a clockwise direction and a counter clockwise direction.

2. The apparatus of claim 1, wherein said rotary valve comprises:

a C-shaped section positioned above said first chamber and said second chamber, said C-shaped section being in selective contact with each of said first tube and said second tube; and a linear lever attached to said C-shaped section and extended out from said reservoir;

wherein displacement of said linear lever about the centrally registered longitudinal axis causes diametrically opposed ends of said C-shaped section to selectively engage said first tube and said second tube.

3. The apparatus of claim 2, wherein each of said opposed ends of said C-shaped section includes a curvilinear slot having a width converging towards said linear lever.

4. The apparatus of claim 3, wherein each of said first tube and said second tube is selectively squeezed when slidably inserted into a corresponding one of said angled slot, and thereby restricts a flow rate of first liquid and said second liquid egressed from said first chamber and said second chamber, respectively.

5. The apparatus of claim 1, wherein said viscosity reducer comprises: a polyorganosiloxane.

6. The apparatus of claim 1, wherein said wrinkle remover is 40% by weight, said fabric softener is 40% by weight, said viscosity reducer is 20% by weight, and said viscosity level is 1.0 centipoise at 25 degrees Celsius.

7. The apparatus of claim 1, wherein said wrinkle remover is 45% by weight, said fabric softener is 45% by weight, said viscosity reducer is 10% by weight, and said viscosity level is 2.0 centipoise at 25 degrees Celsius.

8. An apparatus for removing wrinkles from fabrics and softening the fabrics, comprising:

a portable, hand-held dispensing bottle including a reservoir having a first chamber adapted to contain a first liquid therein and a second chamber adapted to contain a second liquid therein, said second chamber being disposed adjacent to said first chamber, a spray nozzle in fluid communication with each of said first chamber and said second chamber; and mechanism for regulating a flow rate of each said first liquid and said second liquid flowing out from said first chamber and said second chamber, said flow rate regulating mechanism being coupled to said reservoir and said spray nozzle in such a manner that a first quantity of said first liquid and a second quantity of said second liquid are selectively extracted from said first chamber and said second chamber, respectively, and thereby form a solution prior to being discharged from said spray nozzle;

wherein said solution includes between 40% and 45%, by weight, of a wrinkle remover, between 40% and 45%, by weight, of a fabric softener, and between 10% and 20%, by weight, of a viscosity reducer;

wherein said solution is an aqueous mixture having a viscosity level between 1.0 and 2.0 centipoise at 25 degrees Celsius;

wherein, upon actuation of said spray nozzle, said solution is caused to expel outwardly and away from said reservoir due to its low viscosity characteristics;

wherein said first liquid contains said wrinkle remover;

wherein said second liquid contains said fabric softener and said viscosity reducer;

wherein said reservoir comprises a first tube disposed within said first chamber and coupled to said spray nozzle, and a second tube disposed within said second chamber and coupled to said spray nozzle;

wherein said flow rate regulating mechanism comprises a rotary valve centrally seated subjacent to said spray nozzle and above each of said first chamber and said second chamber;

wherein said rotary valve is selectively rotated, about a centrally registered longitudinal axis of said reservoir, in a clockwise direction and a counter clockwise direction.

9. The apparatus of claim 8, wherein said rotary valve comprises:

a C-shaped section positioned above said first chamber and said second chamber, said C-shaped section being in selective contact with each of said first tube and said second tube; and a linear lever attached to said C-shaped section and extended out from said reservoir;

wherein displacement of said linear lever about the centrally registered longitudinal axis causes diametrically opposed ends of said C-shaped section to selectively engage said first tube and said second tube.

10. The apparatus of claim 9, wherein each of said opposed ends of said C-shaped section includes a curvilinear slot having a width converging towards said linear lever.

11. The apparatus of claim 10, wherein each of said first tube and said second tube is selectively squeezed when slidably inserted into a corresponding one of said angled slot, and thereby restricts a flow rate of first liquid and said second liquid egressed from said first chamber and said second chamber, respectively.

* * * * *